US005794350A

United States Patent [19]

Shand

[11] Patent Number: 5,794,350

[45] Date of Patent: Aug. 18, 1998

[54] UTILITY KNIFE ADAPTOR

[76] Inventor: James Shand, 130 School St., Revere, Mass. 02151

[21] Appl. No.: 791,664

[22] Filed: Jan. 30, 1997

[51] Int. Cl.[6] ..... B26B 29/02

[52] U.S. Cl. ..... 30/294; 30/90.4; 30/162

[58] Field of Search ..... 30/294, 293, 289, 30/337, 131, 162, 90.4

[56] References Cited

U.S. PATENT DOCUMENTS 1,129,310 2/1915 Platt ..... 30/90.4 X 2,120,960 6/1938 Arthur ..... 30/2

3,898,733 8/1975 Cormier ..... 30/294 X 5,289,637 3/1994 Coffey ..... 30/294

*Primary Examiner*—Douglas D. Watts

[57] ABSTRACT

A new Utility Knife Adaptor which provides several embodiments of utility knife adaptors thus allowing users to safely strip away wires and cut angles in wood. The inventive device includes a cover. The cover comprises a short rectangular cross-sectional metal sleeve which can be slipped over the front housing of a utility knife

3 Claims, 3 Drawing Sheets

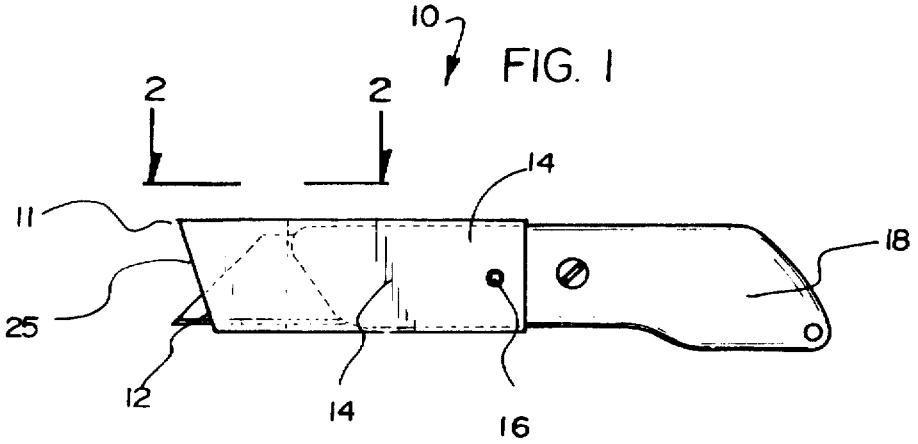
FIG. 1
FIG. 2
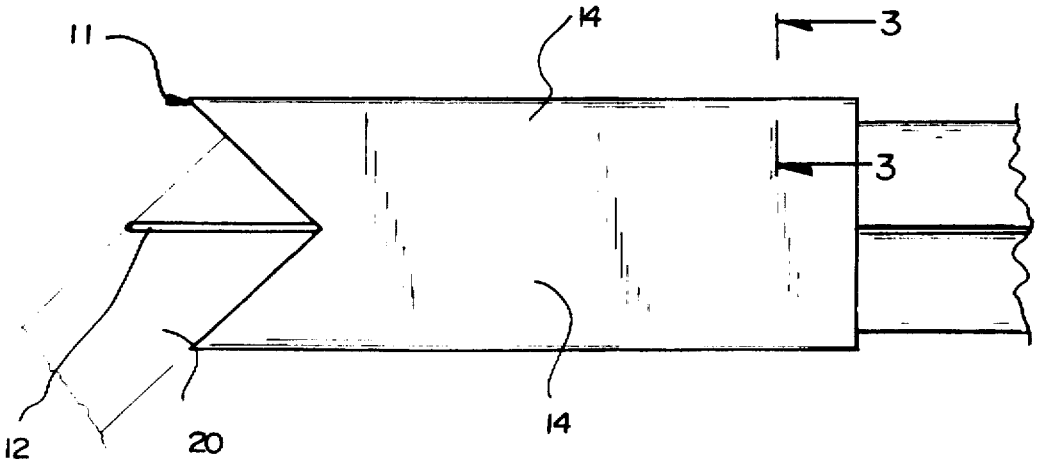

UTILITY KNIFE ADAPTOR

BACKGROUND OF THE INVENTION

1. Field of the Invention

The present invention relates to knife adaptors and more particularly pertains to a new Utility Knife Adaptor for providing several embodiments of utility knife adaptors which allows users to safely strip away wires and cut angles in wood.

2. Description of the Prior Art

The use of knife holders is known in the prior art. More specifically knife holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art knife holders include U.S. Pat. No. 4,631,829; U.S. Pat. No. 4,953,293; U.S. Pat. No. 348,819; U.S. Pat. No. 4,744,146; U.S. Pat. No. 4,987,682; and U.S. Pat. No. 4,442,595.

While these devices fulfill their respective, particular objectives and requirements, the aforementioned patents do not disclose a new Utility Knife Adaptor. The inventive device includes a cover. The cover comprises a short rectangular cross-sectional metal sleeve which can be slipped over the front housing of a utility knife.

In these respects, the Utility Knife Adaptor according to the present invention substantially departs from the conventional concepts and designs of the prior art, and in so doing provides an apparatus primarily developed for the providing several embodiments of utility knife adaptors that allows users to safety strip away wires and cut angles in wood. of The inventive device includes providing several embodiments of utility knife adaptors that allows users to safely strip away wires and cut angles in wood

SUMMARY OF THE INVENTION

In view of the foregoing disadvantages inherent in the known types of knife holders now present in the prior art, the present invention provides a new Utility Knife Adaptor construction wherein the same can be utilized for The inventive device includes providing several embodiments of utility knife adaptors that allows users to safely strip away wires and cut angles in wood.

The general purpose of the present invention, which will be described subsequently in greater detail, is to provide a new Utility Knife Adaptor apparatus and method which has many of the advantages of the knife holders mentioned heretofore and many novel features that result in a new Utility Knife Adaptor which is not anticipated, rendered obvious, suggested, or even implied by any of the prior art knife holders, either alone or in any combination thereof.

To attain this, the present invention generally comprises an adaptor for utility knives which includes a cover. The cover comprises a short rectangular cross-sectional metal sleeve which can be slipped over the front housing of a utility knife.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the providing several embodiments of utility knife adaptors that allows users to safely strip away wires and cut angles in wood. of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Utility Knife Adaptor apparatus and method which has many of the advantages of the knife holders mentioned heretofore and many novel features that result in a new Utility Knife Adaptor which is not anticipated, rendered obvious, suggested, or even implied by any of the prior art knife holders, either alone or in any combination thereof.

It is another object of the present invention to provide a new Utility Knife Adaptor which may be easily and efficiently manufactured and marketed.

It is a further object of the present invention to provide a new Utility Knife Adaptor which is of a durable and reliable construction.

An even further object of the present invention is to provide a new Utility Knife Adaptor which is susceptible of a low cost of manufacture with regard to both materials and labor, and which accordingly is then susceptible of low prices of sale to the consuming public, thereby making such Utility Knife Adaptor economically available to the buying public.

Still yet another object of the present invention is to provide a new Utility Knife Adaptor which provides in the apparatuses and methods of the prior art some of the advantages thereof, while simultaneously overcoming some of the disadvantages normally associated therewith.

Still another object of the present invention is to provide a new Utility Knife Adaptor knife adaptors that allows users to safety strip away wires and cut angles in wood Yet another object of the present invention is to provide a new Utility Knife Adaptor which includes a cover. The cover comprises a short rectangular cross-sectional metal sleeve which can be slipped over the front housing of a utility knife Still yet another object of the present invention is to provide a new Utility Knife Adaptor that forms a sleeve over a utility knife so that one embodiment enables sheets of drywall to be more quickly and accurately scored with a tape measure and beveled at a consistent angle.

Even still another object of the present invention is to provide a new Utility Knife Adaptor that in use, in another embodiment permits its users to quickly slit the insulation off of various types of cables without harming the bare or insulated cable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an side view of a new Utility Knife Adaptor according to the present invention.

FIG. 2 is a top view of the adaptor for wood cutting of the present invention.

DESCRIPTION OF THE PREFERRED EMBODIMENT

Figure 3:
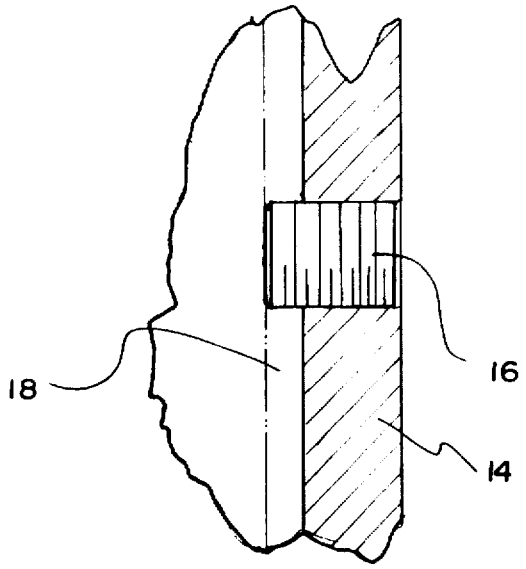
FIG. 3 is a cross-sectional view along line 3—3 of FIG. 2 of the present invention.

With reference now to the drawings, and in particular to FIGS. 1 through 6 thereof, a new Utility Knife Adaptor embodying the principles and concepts of the present invention and an adaptor for utility knives which includes a cover. The cover comprises a short rectangular cross-sectional metal sleeve which can be slipped over the front housing of a utility knife designated by the reference numeral 10 will be described.

More specifically, it will be noted that the Utility Knife Adaptor 10 comprises an adaptor for utility knives which includes a cover. The cover comprises a short rectangular cross-sectional metal sleeve which can be slipped over the front housing of a utility knife.

The present invention includes generally, A Utility Knife Adaptor comprising: a sleeve 14 formed to fit over a utility knife 18. The sleeve 14 comprises a short rectangular cross-sectional metal piece which can be slipped over a front housing 11 of a utility knife 18. The sleeve further comprises a threaded hole 17 which accommodates a screwing means 18 used to hold the sleeve 14 in place.

Figure 4:
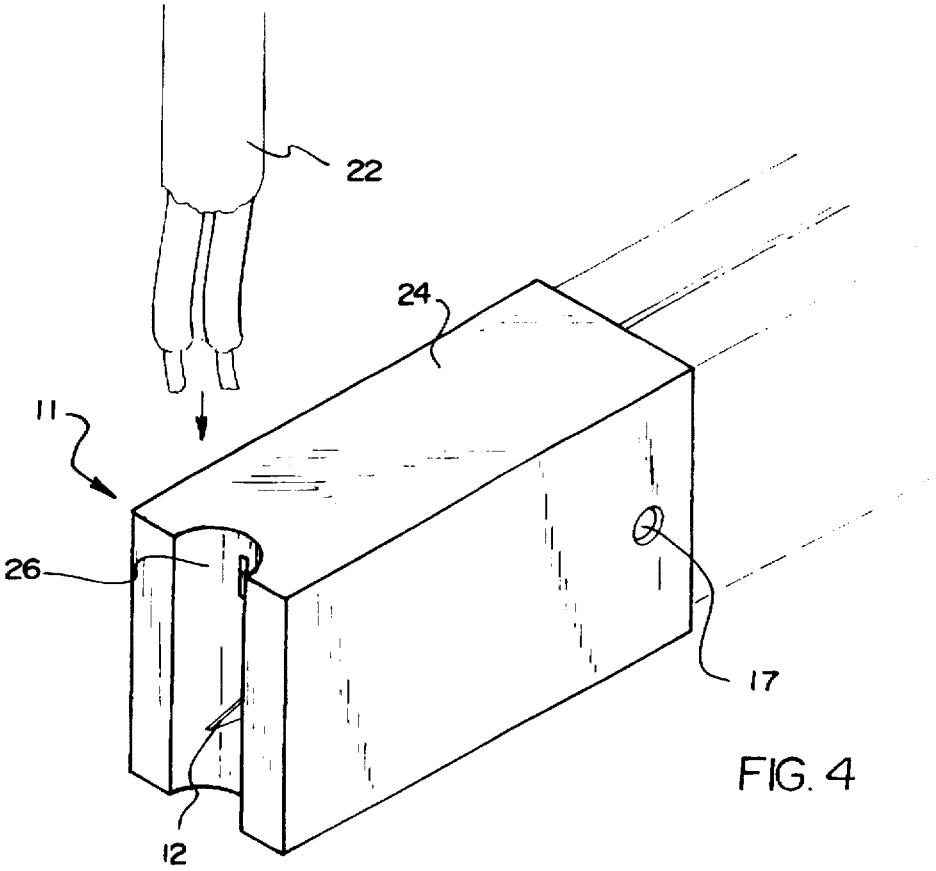
FIG. 4 is a perspective view of one of the wire cutting embodiments of the present invention.
Figure 5:
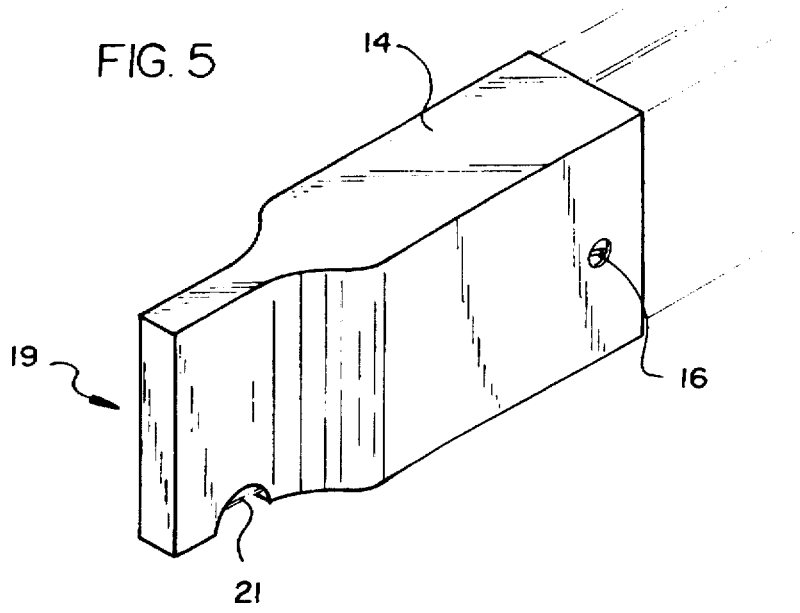
FIG. 5 is a perspective view of the other wire cutting embodiment of the present invention.
Figure 6:
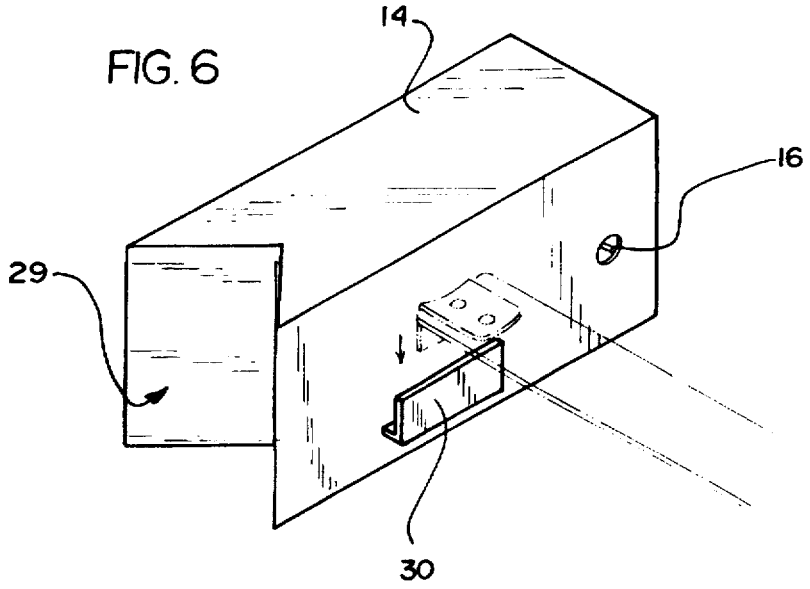
FIG. 6 is a perspective view of an adaptor for wood cutting.

The sleeve further includes a front end 11 Advantageously the front end 11 can be customized to form a curved sections 26, a beveled section 25, and a double angular section 27. The curved section 26 can be used to strip away wires as shown in FIG. 4. Various depths and widths of the curvature are possible to fit the many types of cables and wires for which the present invention was intended to fit. The bevel section 25 of the present invention is intended to fit a utility knife 18 forming the same angular lines as the utility knife 18. The double angular section 27 is preferably configured to form two angles of about 45° with the blade 12 of the utility knife 18.

The sleeve 14 can be made of any suitable material, such as metals or plastic. Preferably the sleeve 14 of the present invention is made of aluminum. The sleeve 14 can also form an elongated housing which tapers into a narrower elongated front 19, with the front end 19 having a lower opening portion 21 which allows the protrusion of a small section of the blade 12 of the utility knife 18.

A holding means 30 is fixedly attached to a side of the sleeve 14. The holding means can be made of material similar to the sleeve 14. The holding means forms a groove which allows the tip of a tape-measure 28 to be removably inserted into the grove to hold the tape 28 in place as the user is cutting a piece of drywall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination, a utility knife adaptor having a front end and a rear end; and a utility knife having a housing with opposite front and rear sections and a blade protruding from the front section, the utility knife adaptor comprising:

a sleeve adapted to fit over the front section of the utility knife, the sleeve including a metal piece which can be slipped over the front section of the housing such that said sleeve encases the front section of the housing to provide a rigid connection between the sleeve and the housing of the utility knife, the metal piece having a substantially rectangular cross section, wherein the sleeve further includes a threaded hole which accommodates a screw advanceable through the threaded hole for selectively pressing against the housing for holding the sleeve in place on said housing, the screw engaging the housing of the utility knife;

wherein the front end of the sleeve is formed into a V-shaped bevel with an opening at the apex of the V-shaped bevel, the blade protruding through the opening in the apex of the V-shaped bevel, the V-shaped bevel is formed at an angle of about 45 degrees;

wherein the V-shaped bevel includes two leading edges, the leading edges being positioned within a plane perpendicular to a longitudinal axis of the sleeve, the plane being rotated such that a top of each leading edge extends further outward than a bottom of each leading edge, the sleeve being positioned such that the blade of the utility knife protrudes through the opening in the apex at the bottom of each leading edge; and wherein the sleeve further comprises an L-shaped member mounted on a side of the sleeve, the L-shaped member forming a holding means for insertion of a tip of a tape measure whereby the tape measure can be held in an extended position by the sleeve.

2. In combination, a utility knife adaptor having a front end and a rear end; and a utility knife having a housing with opposite front and rear sections and a blade protruding from the front section, the utility knife adaptor comprising:

a sleeve adapted to fit over the front section of the utility knife, the sleeve including a metal piece which can be slipped over the front section of the housing such that said sleeve encases the front section of the housing to provide a rigid connection between the sleeve and the housing of the utility knife, the metal piece having a substantially rectangular cross section, wherein the sleeve further includes a threaded hole which accommodates a screw advanceable through the threaded hole for selectively pressing against the housing for holding the sleeve in place on the housing of the utility knife;

wherein the front end of the sleeve includes a curved section forming a hollow having an axis of curvature extending in the same plane of the blade, the curved section being formed at the front end such that a tip portion of a blade of the utility knife extends out into the hollow of the curved section, the curved section adapted to receive a wire shaped member parallel to the axis of curvature such that the tip of the blade penetrates an outer surface of the wire shaped member when the wire shaped member is positioned within the curved section; and wherein the sleeve further comprises an L-shaped member mounted on a side of the sleeve, the L-shaped member forming a holding means for insertion of a tip of a tape measure whereby the tape measure can be held in an extended position by the sleeve.

3. A utility knife adaptor for insertion over an end of a utility knife having a blade with a sharpened edge and a tip adjacent the sharpened edge, the adaptor comprising:

a sleeve adapted to fit over the end of the utility knife, the sleeve having an open end for receiving the end of a utility knife, a closed end opposite the open end for receiving and covering the tip of the blade and a lower edge extending between the open and closed ends, the lower edge being positionable proximate the sharpened edge of the blade;

a curved cutout section being formed in the lower edge of the sleeve to expose a portion of the sharpened edge of the blade in a hollow area of the curved cutout section without exposing the tip of the blade, the perimeter of the curved cutout section curving about an axis of curvature oriented perpendicular to the length of the sharpened edge of the blade such that the curved cutout section is adapted to receive a wire shaped member such that the blade penetrates an outer surface of the wire shaped member when the wire shaped member is positioned within the curved cutout section; and an attachment means for coupling the sleeve to a housing of the utility knife, the attachment means comprising a screw threaded received in a threaded hole for pressing against the housing of a housing of a utility knife.

* * * * *